US006170659B1

(12) United States Patent
Hunter

(10) Patent No.: US 6,170,659 B1
(45) Date of Patent: Jan. 9, 2001

(54) SPACING DEVICE USED TO HOLD SMALL TOYS IN COMPARTMENTS

(76) Inventor: Edward T. Hunter, 2318 Fourth St., Ceres, CA (US) 95307

( * ) Notice: Under 35 U.S.C. 154(b), the term of this patent shall be extended for 0 days.

(21) Appl. No.: 09/314,822

(22) Filed: May 19, 1999

(51) Int. Cl.[7] ..... B65D 85/68

(52) U.S. Cl. ..... 206/335; 206/523; 206/592; 206/814; 53/473

(58) Field of Search ..... 206/521, 523, 206/586, 587, 591, 592, 594, 335, 579, 561, 814; 220/553, 555; 446/76, 78; 53/467, 473, 475

(56) References Cited

U.S. PATENT DOCUMENTS

| | | | | |
|---|---|---|---|---|
| 1,926,916 | | 9/1933 | Reeves . | |
| 1,982,319 | | 11/1934 | Perry . | |
| 2,228,493 | | 1/1941 | Will . | |
| 2,282,908 | | 5/1942 | Thompson . | |
| 2,998,129 | | 8/1961 | Bekins . | |
| 3,421,679 | | 1/1969 | Goldman . | |
| 3,533,503 | * | 10/1970 | Wood | 206/335 |
| 4,905,828 | * | 3/1990 | Dods | 206/335 |
| 4,925,025 | * | 5/1990 | Anten et al. | 206/335 |
| 4,946,413 | * | 8/1990 | Lehmann et al. | 446/76 |
| 5,060,801 | * | 10/1991 | Vilas-Boas | 206/523 |
| 5,271,499 | | 12/1993 | Van Horssen . | |
| 5,358,101 | | 10/1994 | Lombardi . | |
| 5,411,138 | * | 5/1995 | Klawiter | 206/335 |

* cited by examiner

*Primary Examiner*—Luan K. Bui
(74) *Attorney, Agent, or Firm*—Hovey, Williams, Timmons & Collins

(57) ABSTRACT

A spacing device (20), having a compressible body (22) with an upper surface (24) and a lower surface (26), is utilized to inhibit movement of a vehicle (32) stored in a container (34) having a plurality of compartments (78). The upper surface (24) is convexly curved, and the lower surface (26) is concavely curved. An alternate spacing device (60) has a generally non-compressible and transparent body (62) with an inclined upper surface (66) having a recess (68) for receiving the vehicle (32).

8 Claims, 2 Drawing Sheets

SPACING DEVICE USED TO HOLD SMALL TOYS IN COMPARTMENTS

FIELD OF THE INVENTION

This invention relates to storage and display devices and, more particularly, to spacing devices used to hold small toys in compartments. In a preferred embodiment, compressible foam inserts are used to secure toy cars in compartmentalized containers.

BACKGROUND OF THE INVENTION

The demand for small toy vehicles such as HOT WHEELS® and MATCHBOX® cars increases daily. Children desire them as toys, and both adults and children desire them as collectors items. Indeed, collectors are willing to pay thousands of dollars for many of the older vehicles. Collectors of course want to display their vehicle collections both at home and at shows, but traveling to shows with the vehicles increases the risk of damage which can reduce the value of the vehicles.

For convenience, the vehicles are typically transported in compartmentalized containers. However, to accommodate a wide range of vehicle sizes, the individual compartments are too larger for almost all vehicles. Thus, the vehicles are free to move around in the individual compartments of the containers. To inhibit such movement, collectors use packing peanuts and other conventional packaging devices. The packing peanuts are messy and inconvenient, and their ability to inhibit movement is dependent on their positioning relative to the vehicles. Because the peanuts are positioned randomly, they do not sufficiently restrict vehicle movement permitting unacceptable damage. Alternatively, collectors can individually wrap each vehicle. Though individually wrapping each vehicle provides good protection, it is prohibitively time consuming and expensive because large quantities of wrapping material are typically wasted.

Thus, reducing the movement of small toys in compartmentalized containers is desired to reduce damage occurring during transport and maintain the value of the small toys. Further, reducing the labor and expense required to inhibit the movement of small toys encourages further protection of the small toys and increases the economic benefit of collecting small toys.

BRIEF SUMMARY OF THE INVENTION

There is, therefore, provided in the practice of the invention a novel spacing device, which inhibits movement of small toys in compartmentalized containers to protect the small toys from damage. The spacing device includes a compressible body with a toy engaging surface and a wall engaging surface. The compressible body is sized to fit, while compressed, in a compartment with a vehicle.

In a preferred embodiment, the toy engaging surface comprises a lower non-scratch surface having a concavely curved contour, and the wall engaging surface comprises an upper surface having a convexly curved contour. In one embodiment, the ends of the body are rounded, and the body is thicker in the center than at the ends. In that embodiment, the wall engaging surface has a higher degree of curvature than the toy engaging surface. In an alternate embodiment, the body has a substantially constant thickness and is preferably a portion of a ring. In another alternate embodiment, the body has an enlarged hood end for engaging the hood of a vehicle. It is contemplated that the spacing device is used in combination with a compartmentalized container having a plurality of substantially rectangular compartments of generally uniform size separated by thin walls.

In another preferred embodiment, the body is generally non-compressible and has a lower wall engaging surface and an upper, inclined toy engaging surface with a generally rectangular toy receiving recess. The body is preferably made with a substantially transparent material and is provided with an adhesive for adhering the body to the compartment of the container. The rear wall of the body is preferably taller than the front wall of the body thereby providing the inclined upper surface.

Accordingly, it is an object of the present invention to provide an improved spacing device for inhibiting movement of small toys in compartmentalized containers thereby reducing damage.

BRIEF DESCRIPTION OF THE DRAWINGS

These and other inventive features, advantages, and objects will appear from the following Detailed Description when considered in connection with the accompanying drawings in which similar reference characters denote similar elements throughout the several views and wherein.

DETAILED DESCRIPTION

Figure 1:
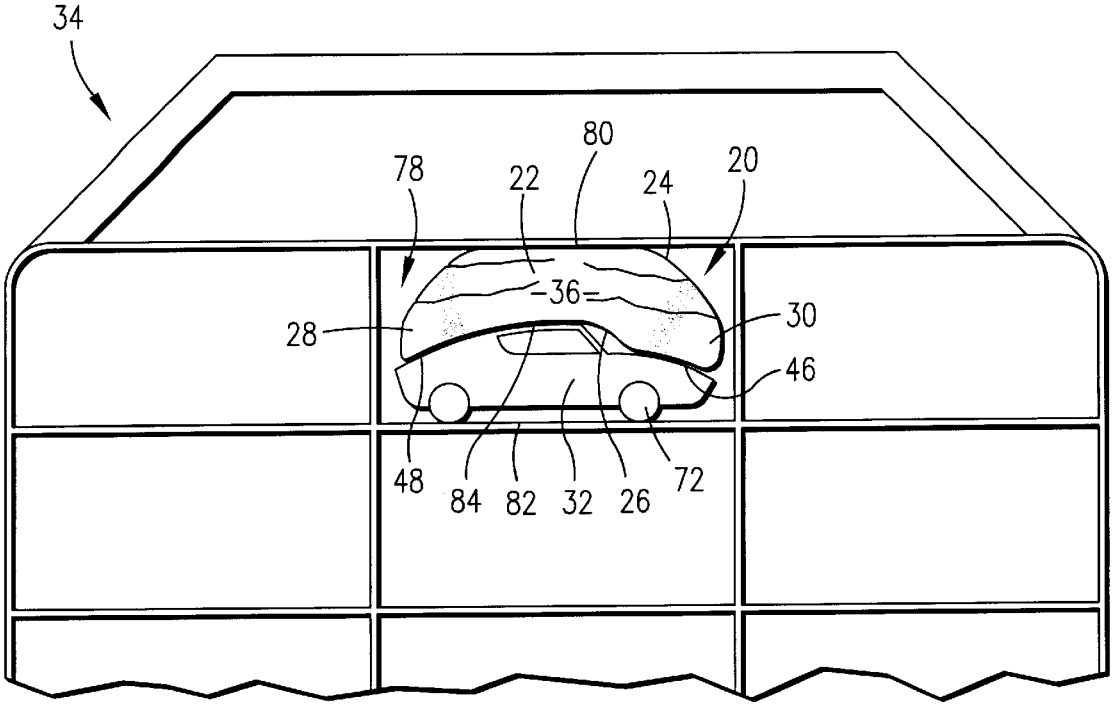
FIG. 1 is an fragmentary front elevational view of a compressible spacing device according to the present invention holding a small toy vehicle in a compartment of a compartmentalized container.

Referring to the drawings in greater detail, FIG. 1 shows a spacing device 20 having a body 22 with an upper surface 24, a lower surface 26, and opposed, rounded ends 28, 30. The spacing device 20 is used to inhibit movement of a small toy, preferably a toy vehicle 32, held in a compartmentalized container 34.

Figure 2:
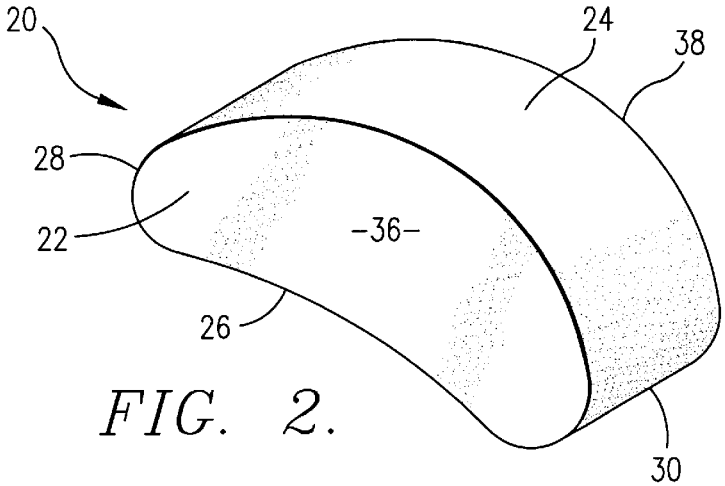
FIG. 2 is a perspective view of the spacing device of FIG. 1.
Figure 3:
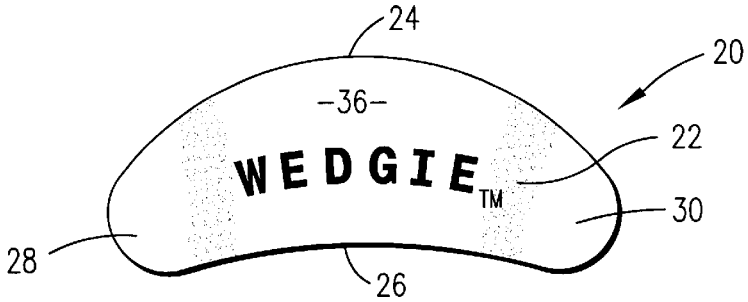
FIG. 3 is front elevational view of the spacing device of FIG. 1.

Referring to FIGS. 2 and 3, the body 22 of the spacing device 20 has a central thickness extending between the upper and lower surfaces 24, 26. The central thickness is greater than the thickness of the body at the ends 28, 30. The body 22 also has a width extending between a front face 36 and a rear face 38. The front face 36 can include printed material matter such as the trademark WEDGIES™. The body 22 is preferably made from an elastically compressible material such as foam, and the thickness and width are selected; so that the body is sized to fit, while compressed, in the container 34 with the vehicle 32 without deforming the vehicle 32. Preferably, the body experiences approximately a 20% compression in thickness.

The upper surface 24 is a container wall engaging surface having a convex contour that is curved and is preferably a portion of a circle. The upper surface 24 tangentially intersects the rounded ends 28, 30 and is designed to frictionally engage the container 34.

The lower surface 26 is a toy engaging surface having a concave contour that is curved and is preferably a portion of a circle. The lower surface 26 also tangentially intersects the rounded ends 28, 30. The degree of curvature of the upper surface is preferably greater than the degree of curvature of the lower surface, so that the center of the body 22 is thicker than the ends 28, 30. That is the upper surface has a smaller radius than the lower surface. At least the lower surface 26 is designed not to scratch the vehicle 32.

Figure 5:
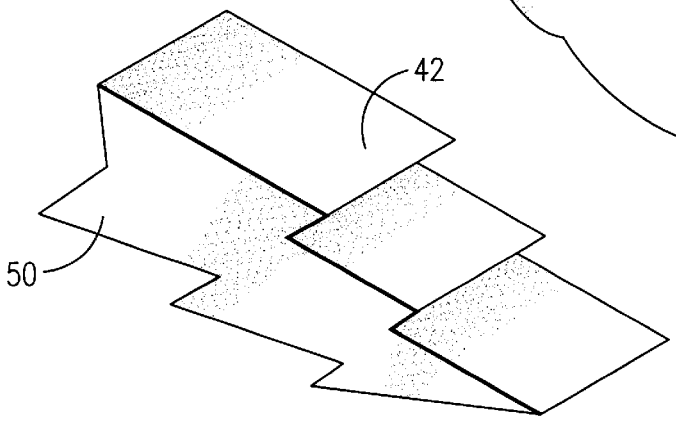
FIG. 5 is a perspective view of another alternate compressible spacing device according to the present invention.
Figure 4:
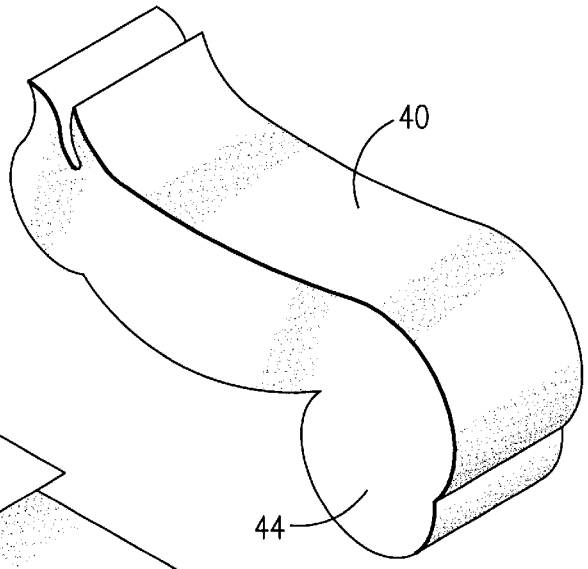
FIG. 4 is a perspective view of an alternate compressible spacing device according to the present invention.

Referring to FIGS. 4 and 5, alternate spacing devices 40, 42 illustrate that a variety of alternate configurations and designs can be utilized. The HOT WHEELS® design spacing device 40 includes an enlarged hood end 44 which engages a hood 46 or trunk 48 (FIG. 1) of the vehicle 32 to securely engage the vehicle and inhibit movement. The lightening bolt spacing device 42 also includes an enlarged end 50. The enlarged ends are sized to fit, while compressed, in the container together with the vehicle 32.

Figure 6:
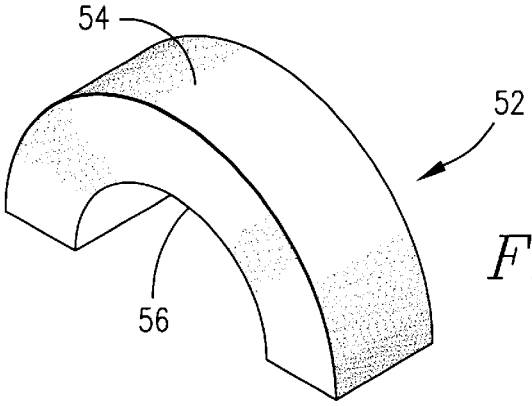
FIG. 6 is a front elevational view of still another alternate compressible spacing device according to the present invention.

Referring to FIG. 6, a ring shaped spacing device 52 is also provided. The ring shaped spacing device 52 comprises a portion of a ring. The thickness of the ring shaped spacing device 52 is substantially constant, and the wall engaging surface 54 has a greater radius than the concentric toy engaging surface 56. The length of the ring can be varied depending on the size of the vehicle. For smaller vehicles, the spacing device can have a sufficient length to surround the vehicle.

Figure 7:
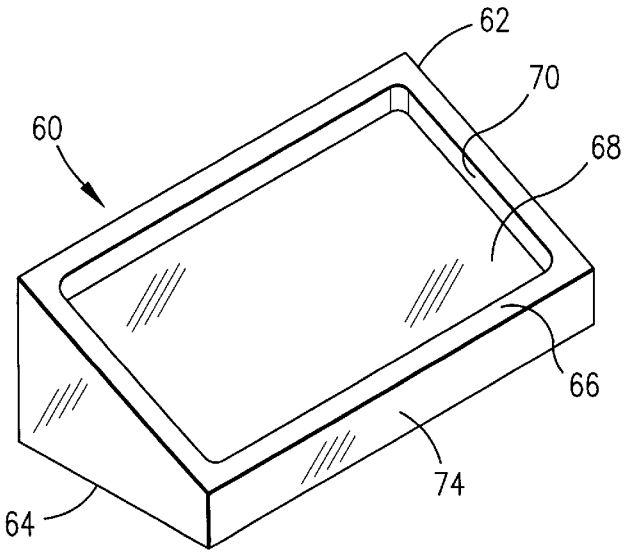
FIG. 7 is perspective view of a generally non-compressible spacing device according to the present invention.
Figure 8:
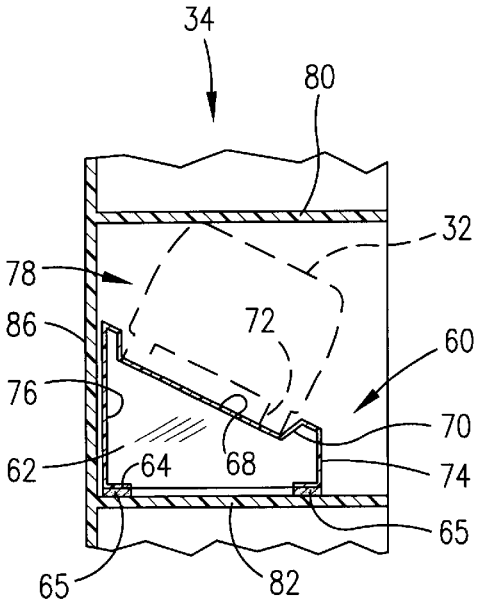
FIG. 8 is a cross-sectional view of the spacing device of FIG. 7 illustrating placement of the spacing device in a compartment with a toy vehicle.

Referring to FIGS. 7 and 8, a spacing device 60 is also provided having a generally non-compressible plastic body 62. The body 62 is preferably made from a substantially transparent material and has a lower wall engaging surface 64 which can be provided with an adhesive 65 to secure the spacing device 60 in the container 34. An upper toy engaging surface 66 is inclined and has a toy receiving recess 68 with outwardly tapered circumferential wall 70 to guide wheels 72 of vehicles 32 into the recess 68. The body 62 also has a front wall 74 with a front wall height and a rear wall 76 with a rear wall height. The front wall height is preferably less than the rear wall height and are sized to fit in the container with the small toy vehicle and inhibit movement.

In operation, the spacing device 20 is inserted into a selected compartment 78 of the container 34 together with a vehicle 32 as illustrated in FIG. 1. The container 34 includes a plurality of substantially rectangular compartments defined and separated by a grid of perpendicularly intersecting thin walls. The body 22 is compressed between the top of the vehicle and the top wall 80 of the compartment 78, and the wheels 72 of the vehicle engage a bottom wall 82 of the compartment. The greatest degree of compression occurs over the roof 84 of the vehicle 32. Thus, the vehicle cannot move up and down. Further, the upper surface 24 of the body frictionally engages the top wall 80 of the compartment 78 inhibiting forward to rearward and side to side movements of the vehicle 32. The operation of the alternate spacing devices 40, 42, 52 having compressible bodies is similar.

Referring again to FIG. 8, the transparent spacing device 60 is inserted in the compartment 78 with the rear wall 76 adjacent to a back wall 86 of the compartment 78. Thus, the recess 68 faces the opening of the compartment making the top and side of the vehicle 32 most visible. Alternatively, the front wall 74 could be positioned adjacent the back wall 86, so that the bottom and side of the vehicle are most visible. The adhesive 65 holds the spacing device 60 in position, and the roof 84 of the vehicle engages the top wall 80 of the compartment to hold the vehicle in the recess 68 and inhibit up and down movement. With the vehicle in the recess, its wheels 72 engage the circumferential wall 70 of the recess to inhibit side to side and forward to rearward movements. To remove the vehicle, the body can be elastically deformed.

Thus, a spacing device is disclosed which utilizes a compressible body to inhibit movement thereby reducing damage during transport and storage. While preferred embodiments and particular applications of this invention have been shown and described, it is apparent to those skilled in the art that many other modifications and applications of this invention are possible without departing from the inventive concepts herein. It is, therefore, to be understood that, within the scope of the appended claims, this invention may be practiced otherwise than as specifically described, and the invention is not to be restricted except in the spirit of the appended claims. Though some of the features of the invention may be claimed in dependency, each feature has merit if used independently.

What is claimed is:

1. In combination:

a container presenting an open top toy-vehicle receiving compartment;

a toy vehicle received in said compartment; and a compressible foam body removably received in said compartment alongside said vehicle without overlying said vehicle to any substantial degree so that said vehicle is at least generally visible through the open top of the compartment, said body being dimensioned so as to engage and be resiliently compressed between the container and the toy vehicle such that the body yieldably presses against the toy vehicle and thereby maintains the position of the toy vehicle within the compartment.

2. The combination according to claim 1 wherein the body comprises a substantially constant thickness.

3. The combination according to claim 1 wherein the body comprises a portion of a ring.

4. The combination according to claim 1 wherein the body is compressed by approximately 20%.

5. The combination according to claim 1 wherein the body presents generally opposite, spaced apart toy engaging and container engaging surfaces, said toy engaging surface having a concave contour and said container engaging surface having a convex contour.

6. The spacing device according to claim 5 wherein the container engaging surface comprises a higher degree of curvature than the toy engaging surface.

7. The combination of claim 1, said compressible body having a non-scratch toy vehicle engaging surface and being positioned intermediate said container and said vehicle wherein said vehicle engaging surface substantially conforms to a portion of said vehicle in engagement therewith.

8. A method of inhibiting movement of small toys within a compartment, comprising the steps of:

providing a toy vehicle and a container having an open top compartment sized to receive the toy therein;

providing a compressible foam body sized for receipt within the compartment;

placing the body and the toy vehicle alongside one another within the compartment, wherein the body engages both the toy vehicle and the container and inhibits relative movement therebetween without substantially overlying said vehicle to any substantial degree so that the vehicle is at least generally visible through the open top of the compartment, said placing step including the step of compressing the body between the container and the toy vehicle, such that the body yieldably presses against the toy vehicle and thereby maintains the position of the toy vehicle within the compartment.

* * * * *